United States Patent [19]

Bonin

[11] Patent Number: 4,833,755

[45] Date of Patent: May 30, 1989

[54] SY19TEM FOR MARKING THE RELATIVE POSITION OF A MOBILE ELEMENT WITH RESPECT TO A FIXED ELEMEMT

[76] Inventor: Lucien Bonin, 28 Bld Carnot, 78110 Le Vesinet, France

[21] Appl. No.: 236,165

[22] Filed: Oct. 17, 1988

Related U.S. Application Data

[63] Continuation of Ser. No. 1,156, Jan. 7, 1987, abandoned.

[30] Foreign Application Priority Data

Jan. 13, 1986 [FR] France ..... 86 00368

[51] Int. Cl.[4] ..... E05D 11/10

[52] U.S. Cl. ..... 16/344; 16/86 A; 16/347

[58] Field of Search ..... 16/82, 86 R, 86 A, 97, 16/98, 333, 334, 335, 344, 345, 347, 363, 364, DIG. 27

[56] References Cited

U.S. PATENT DOCUMENTS 2,915,778 12/1959 DeVito ..... 16/82
3,012,269 12/1961 Bartel ..... 16/86 A
3,304,135 2/1967 Hasselmark ..... 16/98 X
4,472,857 9/1984 Guionie et al. ..... 16/344 X

*Primary Examiner*—Fred A. Silverberg
*Attorney, Agent, or Firm*—Marshall, O'Toole, Gerstein, Murray & Bicknell

[57] ABSTRACT

This invention relates to a system for marking the relative position of a mobile element with respect to a fixed element, the mobile element being able to occupy two extreme positions, close or remote, of the type comprising a lever articulated by one of its ends on the fixed element and a guide disposed on the mobile element and cooperating with the lever, the guide being in the vicinity of the articulation of the lever in the close extreme position and being in abutment against the other end of the lever in the remote extreme position. The guide includes rollers mounted for rotation on flexion bars in the mobile element, the rollers being disposed on either side of the lever, pressing it therebetween. At least one undulatory profile is formed on the lever which is capable of cooperating with one of the rollers, so as to immobilize the mobile element in a desired relative position, when the roller is located in one of the troughs of the profile.

8 Claims, 3 Drawing Sheets

SYSTEM FOR MARKING THE RELATIVE POSITION OF A MOBILE ELEMENT WITH RESPECT TO A FIXED ELEMENT

This is a continuation of application Ser. No. 001,156, filed Jan. 7, 1987, now abandoned.

The present invention relates to a system for marking the relative position of a mobile element with respect to a fixed element, the mobile element being able to occupy two extreme positions, close or remote, with respect to the fixed element.

The term "mobile element" covers for example folding panels, doors, folding doors, gates, etc. . . capable of being moved, independently or not, by any movement, with respect to a fixed element, such as a structure, framework, upright, frame, etc. . .

For example, in the case of vehicles, the mobile element is defined by the door, whilst the fixed element is defined by the upright of the body of the vehicle.

Systems for marking the relative position of the door with respect to the upright of a vehicle generally comprise a lever articulated by one of its ends on the fixed element or upright of the body, and guiding means, disposed on the mobile element or door which cooperate with said lever, of which the other end is located in the inner volume of the door. At least one hinge ensures the movement in rotation, about the vertical axis of the hinge, of the door with respect to the upright. These guiding means are at present constituted by a roller borne by a fork joint, and maintained against an undulatory profile formed on one of the lateral edges of the lever, by a spring. On the other lateral edge are applied elastic members which oppose the action of the spring so as to guide and maintain the lever against the roller. The mobile element such as the door is thus maintained in a desired position with respect to the fixed element, such as the upright of the vehicle, by means of the roller which immobilizes the door when it is located in one of the troughs of the undulatory profile.

The systems incorporating these guiding means give suitable results, but they are sometimes unreliable, due to the repeated openings and/or closures which amplify the various functional clearances between the parts. For instance, certain of them, and in particular the guiding means, risk being deteriorated, resulting in difficulties in, and even the impossibility of opening and/or closing the door or of maintaining it in an intermediate position.

Moreover, such systems necessitate frequent lubrication, which is not always done, leading to operational seizures between the parts and unpleasant noises.

It is an object of the present invention to overcome these drawbacks by proposing a system for marking the relative position of a mobile element with respect to a fixed element, which is of increased reliability, of reduced maintenance, operating silently and which is insensitive to the outside variations in temperature.

To this end, according to the invention, the system for marking the relative position of a mobile element with respect to a fixed element, said mobile element being able to occupy two extreme positions, close or remote, of the type comprising a lever articulated by one of its ends on said fixed element and guiding means disposed on said mobile element and cooperating with said lever, said guiding means being in the vicinity of the articulation of said lever in the close extreme position and being in abutment against the other end of said lever, in the remote extreme position, is noteworthy in that said guiding means are constituted by rollers mounted to rotate and fast with said mobile element, said rollers being disposed on either side of said lever, pressing it therebetween, an undulatory profile formed on said lever being capable of cooperating with at least one of said rollers, so as to immobilize said mobile element in a desired relative position, when said roller is located in one of the troughs of said profile.

Two undulatory profiles are advantageously formed respectively on either side of said lever and are symmetrical to each other with respect to a median plane of said lever, each roller cooperating with one of said profiles. In this way, the efforts exerted by said rollers, elastically deformable, on the profiles are of opposite directions, one towards the other, this providing an efficient maintenance of the lever in each desired position defined by the troughs of the profiles. Said rollers are for example made of synthetic plastics material, which reduces maintenance of the system and renders operation quieter. The end of said lever, marking the remote extreme position of said mobile element with respect to said fixed element, is preferably bent, at least one of said rollers coming into abutment against this end. In a preferred embodiment, said rollers each comprise two side members between which is formed a groove cooperating with each undulatory profile, said grooves thus forming a guide for said lever. Each roller is mounted on a flexible bar disposed in a housing fast with said mobile element. The flexibility of the bars on which the rollers are mounted helps to provide functional clearance for the undulatory profile of the lever to pass between the rollers mounted on the flexible bars.

The ends of the flexible bars may advantageously be respectively surrounded by an elastomer support arranged in the housing, thus allowing a functional clearance of each bar with respect to the housing. A ring, made of synthetic material, may also be interposed between each of the rollers and flexion bars, increasing the operational quietness of the system.

The invention will be more readily understood on reading the following description with reference to the accompanying drawings, in which like references denote like elements.

Figure 1:
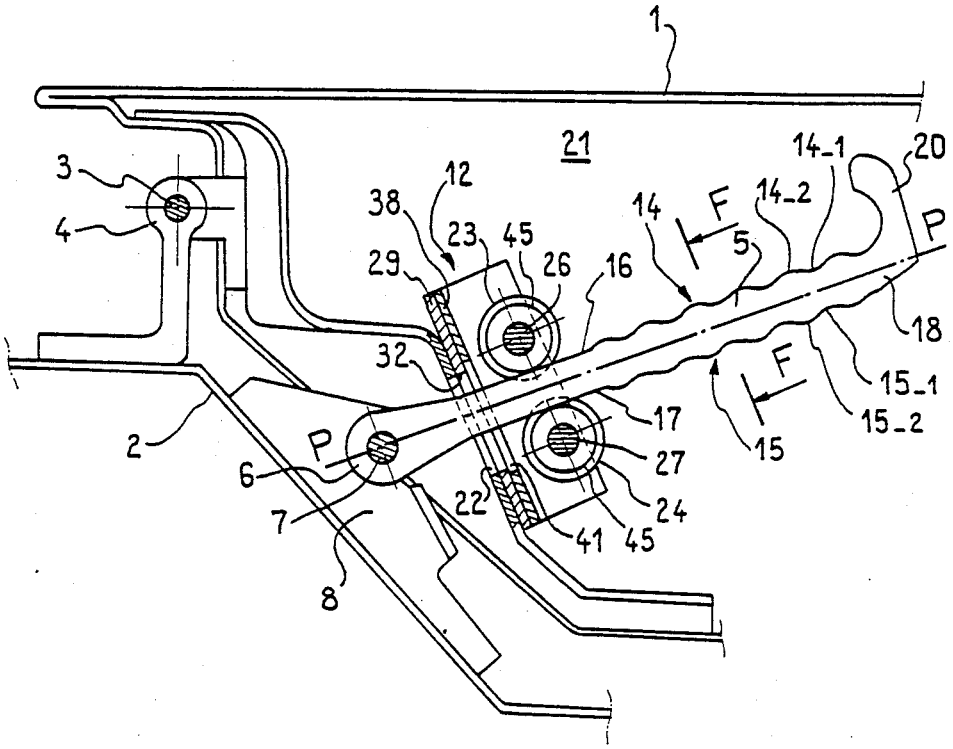
FIGS. 1 and 2 show the system according to the invention applied to a vehicle door respectively in a closed position and in an open position of the door with respect to the upright.

Referring now to the drawings, the system according to the invention shown therein is intended to mark the relative position of a mobile element, such as a vehicle door 1, with respect to a fixed element, such as a body upright 2 of said vehicle.

Door 1 and upright 2 are articulated about a vertical pin 3 of a hinge 4. Door 1 rotates about this axis 3.

It goes without saying that, for other applications, the movement may be different from that presented in this example.

The system comprises, on the one hand, a lever articulated by one of its ends 6, about a pivot pin 7, mounted on lugs 8 fast with upright 2 of the vehicle and, on the other hand, guiding means 12 disposed on door 1 and cooperating with lever 5.

More precisely, lever 5 advantageously comprises two undulatory profiles 14 and 15 formed respectively on each of the lateral edges 16 and 17 of the lever. Profiles 14 and 15 are symmetrical with respect to a median plane P of lever 5 and respectively define troughs 14-1, 15-1 and peaks 14-2, 15-2. End 18 of lever 5, opposite the one articulated about pivot pin 7, is bent, thus defining a stop 20.

The major part of lever 5, with the exception of end 6, is arranged in the inner volume 21 of door 1, which comprises an opening 22 allowing said lever to be placed in position and moved.

The guiding means 12 according to the invention are advantageously constituted by two rollers 23, 24, mounted to rotate, each borne by a flexible bar or shaft 26, 27 arranged in a housing 29. The latter is fast with door 1 via screws 30 shown in FIGS. 3 to 6, and also comprises an opening 32 made opposite opening 22.

Ends 33, 34 of bar 26 bearing roller 23 and ends 35, 36 of bar 27 bearing roller 24, are imprisoned by a cage 38 in slots 39 made in the walls of the housing 29 serving as support for the ends of bars 26 and 27. Cage 38 is fast with housing 29 by means, for example, of welding spots 40 and is also provided with an opening 41 disposed opposite the preceding openings 22 and 32.

Rollers 23 and 24 each comprise two side members 43 and 44 between which is formed a groove 45 cooperating with each undulatory profile 14 and 15. Each groove 45, surrounded by its lateral members 43 and 44, forms a guide for lever 5 and exerts a pressure on the side edges 16 and 17 and consequently the undulatory profiles 14 and 15. The efforts exerted by the rollers are advantageously in opposition to one another, thanks to the symmetrical arrangement of profiles 14 and 15. The lever is thus maintained in a plane defined by articulation 6 and rollers 23 and 24.

In a preferred embodiment, the rollers are made of synthetic resinous plastics material or the like, presenting good characteristics of elasticity, with reduced maintenance and quieter operation.

Operation of the system will be described with reference to FIGS. 1 and 2.

More precisely, FIG. 1 illustrates the door 1 of a vehicle in a closed extreme position, the guiding means 12 being in their position closest to the pivot pin 7 of lever 5. The grooves 45 of rollers 23 and 24 are in contact with the lateral edges 16 and 17 of lever 5, but outside the undulatory profiles 14 and 15.

Figure 2:
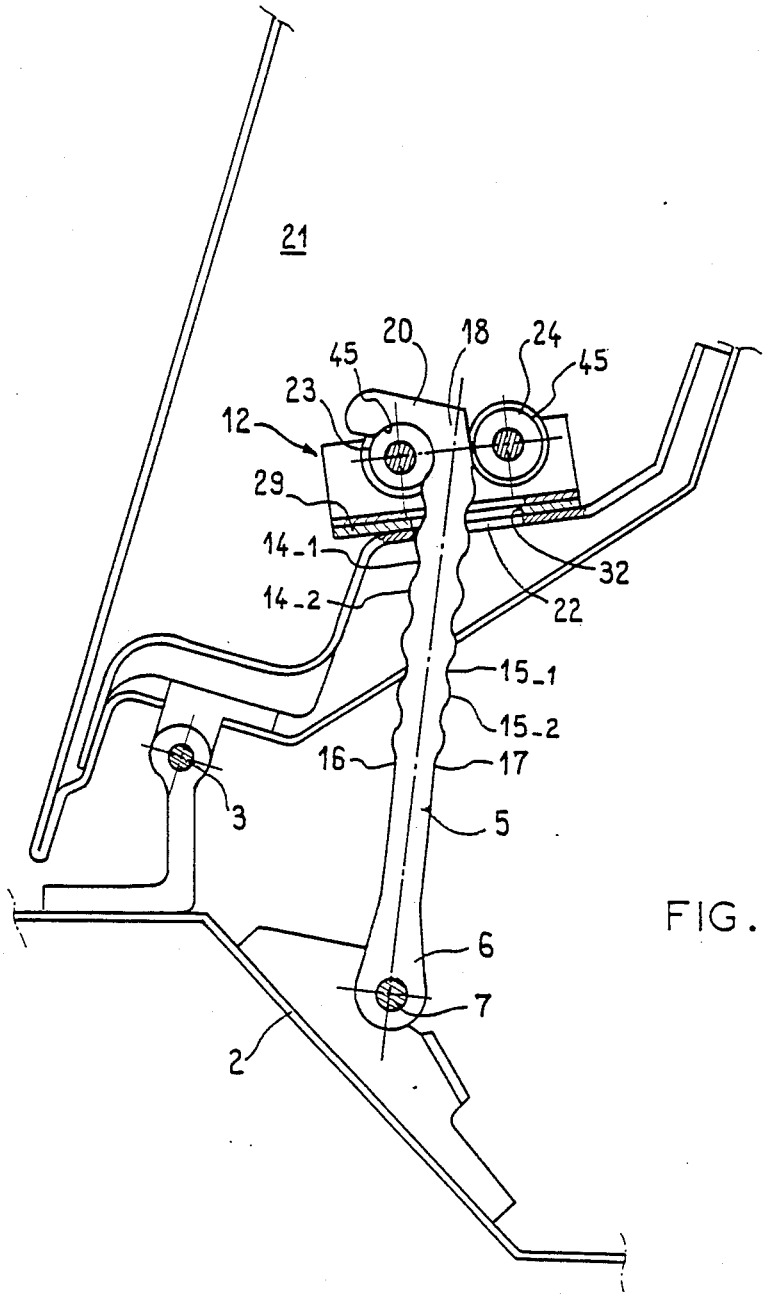
Figure 3:
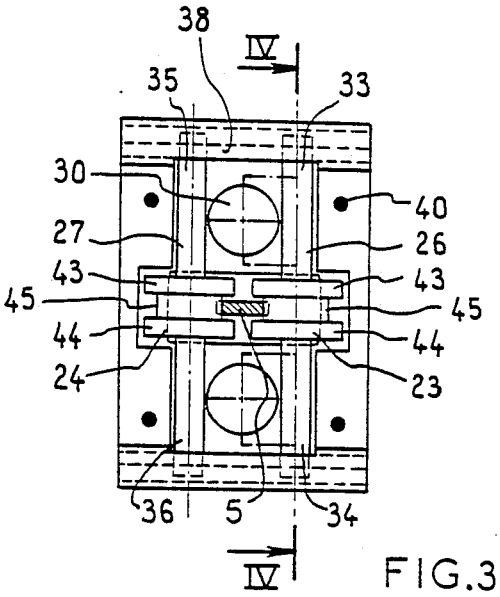
FIG. 3 shows a view of the embodiment of the system in the direction of arrows F of FIG. 1.
Figure 4:
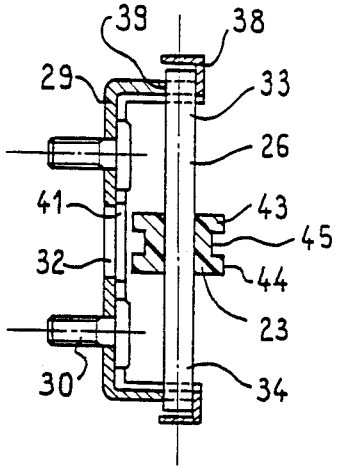
FIG. 4 shows a section along IV—IV of FIG. 3.

When it is desired to open the door so that it is maintained for example in the other open extreme position illustrated in FIG. 2, a handle (not shown in the drawings) fast with door 1 is actuated, which pivots about the pivot pin 3 of hinge 4 with respect to upright 7 of the vehicle body. Rollers 23 and 24, fast with the door via flexible bars 26 and 27 mounted on housing 29, roll on undulatory profiles 14 and 15, passing successively over troughs 14-1, 15-1 and peaks 14-2, 15-2 by being elastically deformed. Lever 5, guided by grooves 45 and side members 43, 44 of the rollers, pivots about the axis of pivot pin 7 with respect to upright 2. The open extreme position is attained when one of the rollers, in the present case roller 23, is against stop 20 of the bent end 18 of lever 5. In another embodiment, a stop may also be provided against roller 24.

In this configuration, rollers 23 and 24 are in troughs 14-1 and 15-1 and thus immobilize door 1 in position with respect to upright 2.

A plurality of intermediate positions of door 1 with respect to upright 2 may also be obtained. The number of troughs made on the profiles defines the number of positions that the door may occupy. The door may be stopped and maintained in any position without difficulty; the grooves of the rollers are always in contact with the undulatory profiles, thanks to the elastic deformation thereof when passing over the peaks, said grooves returning to their initial position when they are in contact with the troughs.

The system according to the invention operates silently thanks to the material with which said rollers are made, without this necessitating any maintenance.

Figure 5:
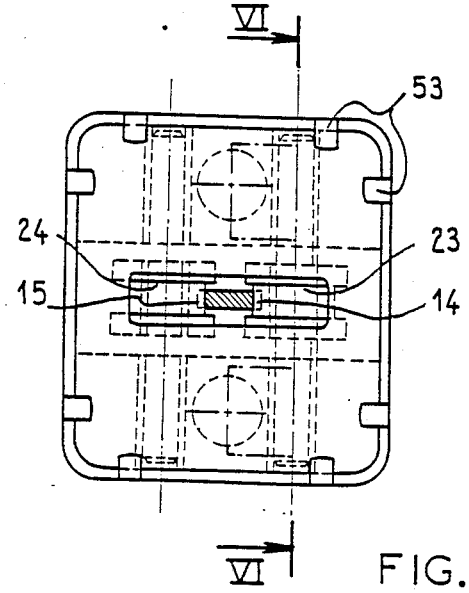
FIGS. 5 and 6 show a variant embodiment of the invention in accordance with the same indications shown in FIGS. 3 and 4.
Figure 6:
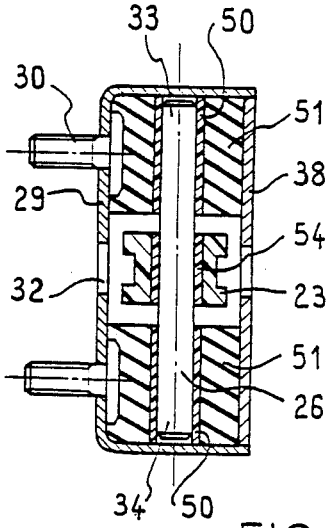

FIGS. 5 and 6 show two views of a variant embodiment of the system according to the invention, which particularly renders operation quieter.

To this end, ends 33 and 34 of bar 26 and ends 35 and 36 of bar 27 are surrounded by a bushing 50 adhering within a support 51, preferably made of elastomer. These supports 51 are maintained and imprisoned in housing 29 by cage 38 of simplified form, but with identical function. The cage is fast with housing 29 via metallic tongues 53 provided on the housing and bent against the cage. This variant embodiment ensures in particular a freedom of movement of the two bars 26, 27 with respect to their respective axis, during operation of the system. The bars are thus mounted to float in supports 51.

A ring 54, preferably made of synthetic material of the plastics type, is advantageously interposed between rollers 23, 24 and bars 26, 27, this rendering operation of the system quieter.

The system described hereinabove therefore presents determining advantages over the systems of the prior art, particularly thanks to the means for guiding and maintenance with respect to the lever and the symmetrical efforts exerted by the rollers mounted in opposition against the lever. Moreover, virtually no maintenance is necessary for the system; the life and operational silence of the system are increased. Similarly, the variations in outside temperature to which the system is subjected have no influence on the operation thereof.

What is claimed is:

1. In a system for marking the relative position of a mobile element with respect to a fixed element, said mobile element being able to occupy two extreme positions, close or remote, of the type comprising a lever articulated by one of its ends on said fixed element and guiding means disposed on said mobile element and cooperating with said lever, said guiding means being in the vicinity of the articulation of said lever in the close extreme position and being in abutment against the other end of said lever in the remote extreme position, said guiding means comprising rollers mounted for rotation on said mobile element and disposed on either side of said lever pressing it therebetween, said lever having at least one undulatory profile defining a plurality of troughs capable of cooperating with one of said rollers, so as to immobilize said mobile element in a desired relative position when said roller is located in one of the trough of said profile, the improvement comprising:

a housing mounted on said mobile element, a pair of spaced generally parallel flexible bars on each of which is mounted for rotation one of said rollers, and a resilient elastomeric support surrounding each end of said bars and operatively connecting said bars to said housing, whereby said bars flex to provide functional clearance between said rollers for the undulatory profile of said lever as said mobile element moves between its extreme positions.

2. The system of claim 1, wherein said housing in which are mounted said bars bearing said rollers, is provided with an opening for the passage of said lever.

3. The system of claim 1 wherein a ring, made of synthetic material, is interposed between each of said rollers and said bars.

4. The system of claim 1 wherein said rollers are made of synthetic resinous plastics material or the like.

5. The system of claim 1 wherein two undulatory profiles are respectively formed on either side of said lever, each roller cooperating with one of said profiles.

6. The system of claim 5, wherein the two profiles are symmetrical to each other with respect to a median plane of said lever.

7. The system of claim 1 wherein the end of said lever, marking the remote extreme position of said mobile element with respect to said fixed element, is bent.

8. The system of claim 1 wherein said rollers each comprise two side members between which is formed a groove cooperating with each undulatory profile, said grooves forming guide for said lever.

* * * * *